United States Patent [19]

Garg

[11] Patent Number: 4,486,293

[45] Date of Patent: Dec. 4, 1984

[54] CATALYTIC COAL HYDROLIQUEFACTION PROCESS

[75] Inventor: Diwakar Garg, Macungie, Pa.

[73] Assignee: Air Products and Chemicals, Inc., Allentown, Pa.

[21] Appl. No.: 488,553

[22] Filed: Apr. 25, 1983

[51] Int. Cl.[3] ..... C10G 1/08

[52] U.S. Cl. ..... 208/10

[58] Field of Search ..... 208/10

[56] References Cited

U.S. PATENT DOCUMENTS

| | | | |
|---|---|---|---|
| 1,934,023 | 11/1933 | Wright | 196/53 |
| 2,227,672 | 1/1941 | Pier et al. | 196/53 |
| 2,486,361 | 10/1949 | Nahin et al. | 196/28 |
| 2,748,062 | 5/1956 | Doumani | 196/50 |
| 2,753,296 | 7/1956 | Sellers | 196/53 |
| 2,812,309 | 11/1957 | Allyn et al. | 252/470 |
| 2,812,310 | 11/1957 | Walker et al. | 252/470 |
| 2,860,101 | 11/1958 | Pelipetz | 208/10 |
| 2,871,200 | 1/1959 | Doumani | 252/440 |
| 2,871,201 | 1/1959 | Doumani | 252/440 |
| 3,488,279 | 1/1970 | Schulman | 208/10 |
| 3,502,564 | 3/1970 | Hodgson | 208/9 |
| 3,532,617 | 10/1970 | Hodgson | 208/10 |
| 3,619,404 | 11/1971 | Rieve et al. | 208/10 |
| 3,687,838 | 8/1972 | Seitzer | 208/10 |
| 3,745,108 | 7/1973 | Schuman et al. | 208/10 |
| 3,884,796 | 5/1975 | Hinderliter et al. | 208/8 |
| 4,021,329 | 5/1977 | Seitzer | 208/10 |
| 4,077,867 | 3/1978 | Aldridge et al. | 208/10 |
| 4,090,943 | 5/1978 | Moll et al. | 208/10 |
| 4,102,775 | 7/1978 | Quarderer et al. | 208/10 |
| 4,134,825 | 1/1979 | Borden, Jr. et al. | 208/108 |
| 4,136,013 | 1/1979 | Moll et al. | 208/10 |
| 4,214,977 | 7/1980 | Ranganathan et al. | 208/10 |
| 4,369,106 | 1/1983 | Aldridge et al. | 208/10 |
| 4,379,744 | 4/1983 | Rosenthal et al. | 208/10 |
| 4,411,766 | 10/1983 | Garg et al. | 208/10 |

FOREIGN PATENT DOCUMENTS

| | | | |
|---|---|---|---|
| 2729508 | 1/1978 | Fed. Rep. of Germany | 208/10 |

*Primary Examiner*—Carl F. Dees
*Assistant Examiner*—Lance Johnson
*Attorney, Agent, or Firm*—Geoffrey L. Chase; E. Eugene Innis; James C. Simmons

[57] ABSTRACT

A process is described for the liquefaction of coal in a hydrogen donor solvent in the presence of hydrogen and a co-catalyst combination of iron and a Group VI or Group VIII non-ferrous metal or compounds of the catalysts.

13 Claims, No Drawings

CATALYTIC COAL HYDROLIQUEFACTION PROCESS

TECHNICAL FIELD

The Government of the United States of America has rights in this invention pursuant to Contract Number DE-AC22-79ET14806 awarded by the U.S. Department of Energy.

The present invention is directed to the liquefaction of coal using a hydrogen donor solvent in order to recover appreciable amounts of liquid fuels and solvent refined coal. More particularly, the invention is directed to catalysts which enhance the recovery of liquid fuels from coal in such a reaction.

BACKGROUND OF THE PRIOR ART

The recovery of liquid fuels from coal is well documented in the prior art. Various methods for the recovery of liquid fuel from coal have been made, but generally the percentage conversion of coal to liquid fuels have been sufficiently low such that the process is uneconomical. In order to increase the liquid fuel product of coal conversion, attempts have been made to catalyze the coal liquefaction reaction. Various expensive supported catalysts have shown high activity for coal liquefaction catalysis. However, due to the mineral content and coking tendency of coal in liquefaction reactions, the use of such expensive catalysts is unattractive for economic reasons despite catalyst regeneration techniques.

In an attempt to overcome the problem of using expensive supported catalysts in coal liquefaction, the prior art has suggested the use of various inexpensive, potentially throw-away, catalysts which do not require regeneration for economic process operation. Various inexpensive catalysts for coal liquefaction are known, such as iron and its compounds. Alternately, the prior art has suggested the use of low concentrations (ca. 250 ppm of catalyst based on coal) of expensive catalysts in order to render the coal liquefaction reaction economical.

U.S. Pat. No. 2,227,672 discloses the use of a sulfur or phosphate compound of iron, manganese, copper or zinc and a minor proportion of a strong hydrogenation catalyst such as molybdenum, tungsten, cobalt, rhenium, vanadium or nickel or their sulfides as catalysts for the hydrogenation of carbonaceous material such as middle oil, tars and even coal.

U.S. Pat. No. 3,152,063 discloses a process for the hydrogenation of coal without a pasting oil or solvent wherein the coal is subjected to high temperatures after being impregnated with a hydrogenation catalyst such as ammonium molybdate or iron group catalysts and their compounds. The coal is preferably impregnated with catalyst in the form of a solution of a soluble salt or complex. The reaction product is immediately cooled after liquefaction.

U.S. Pat. No. 3,502,564 discloses that hydrogenation catalysts may be formed in situ after the components of the catalyst are impregnated on coal. The catalysts contemplated are the sulfides or naphthanates of nickel, tin, molybdenum, cobalt, iron and vanadium. The process is not utilized in a solvent refining environment.

U.S. Pat. No. 3,619,404 discloses the liquefaction of coal without solvent using supported catalysts such as iron, cobalt, nickel, vanadium, molybdenum or tungsten or compounds of such metals alone or in admixture.

In U.S. Pat. No. 3,745,108 a method for hydrogenating coal to produce a liquid product is set forth wherein at least 25 wt% of the solvent for the liquefaction reaction comprises water. Catalyst for the reaction may be supported on a carrier or impregnated directly on the coal. Catalyst metals include iron, cobalt, nickel, vanadium, molybdenum or tungsten, compounds of these metals and mixtures of the combinations.

Despite the use of various process systems and catalysts and catalyst combinations, the prior art has failed to significantly increase the production of liquid fuels from coal. Therefore, the present invention will be shown to provide a process for increasing the liquid fuel product of a coal liquefaction in a dramatic manner while reducing or maintaining the hydrocarbon gas production and the hydrogen consumption for such a process and thereby providing an economic scheme for the production of liquid fuels from coal. The present invention will be demonstrated to have a higher selectivity for oil than the processes generally known in the prior art, along with a greater coal conversion.

BRIEF SUMMARY OF THE INVENTION

The present invention is directed to a process for the liquefaction of coal in an essentially hydrocarbon hydrogen donor solvent at a temperature above 750° F. using an unsupported co-catalyst combination of iron and a Group VI or VIII non-ferrous metal or compounds of the catalyst. The reaction is preferably carried out at a pressure of 500 to 5000 psia using hydrogen gas.

Preferably the co-catalyst combination is impregnated on the coal prior to the liquefaction reaction. The catalyst impregnation is achieved by the use of soluble compounds of the metal catalysts, such as inorganic or organic acid salts. The Group VI or VIII non-ferrous catalyst is preferably selected from the group comprising molybdenum, tungsten, rhenium, cobalt or nickel.

Preferably, the co-catalyst combination is iron sulfate and ammonium molybdate. The iron should predominate in the catalyst combination and preferably the catalyst is used in an amount of approximately 0.5–5 wt% iron based on coal feed and 0.005–0.05 wt% of the Group VI or VIII catalyst based on feed coal. The ratio of the iron catalyst to the nonferrous catalyst should be in the range of 97.5/2.5% to 99.5/0.5% based on metal.

Although any essentially hydrocarbon hydrogen donor solvent may be utilized in the present invention, optimally, the hydrogen donor solvent is generated in situ by the presence of hydrogen gas in the reaction zone under high pressure or formed from a portion of the liquid product of the liquefaction process. The solvent can then be recycled for continuous use.

Preferably, the solvent refining reaction is performed in an upflow tubular reactor or well mixed slurry reactor.

DETAILED DESCRIPTION OF THE INVENTION

The subject coal liquefaction process can be used with various grades of coal, such as bituminous, subbituminous and lignite. These coals can be used directly or processed to remove mineral matter by known processes. The feed coal should be dried and ground to an appropriate particle size (60 mesh or finer) or, in some cases, the coal may be used directly for the liquefaction reaction. Preferably, the coal is predried to reduce moisture levels to those adequately handled in coal slurry equipment.

The process of the present invention is a catalytic coal liquefaction process in which solid coal is converted in unexpectedly high yields to liquid product or distillable oils. The reaction also produces a minimal amount of hydrocarbon gases, residual refined coal known as solvent refined coal (SRC) and liquefaction residue containing unconverted coal and ash. In the process, particulate coal preferably in a size range of 60 to 400 mesh is impregnated with a combination of two catalysts in a soluble form. The impregnation may be performed with a water or organic solvent solution of the catalysts prior to the coal being introduced into a liquefaction reactor. The catalysts comprise a co-catalyst combination of an iron compound such as an inorganic or organic acid salt, while the other catalyst is a metal selected from either Group VI or VIII of the Periodic Table, but excluding iron. This second catalyst is also in the form of a compound, such as an inorganic or an organic acid salt. Preferably, the second catalyst comprises molybdenum, tungsten, rhenium, cobalt or nickel.

Oil soluble compounds of iron and Group VI and VIII non-ferrous metals, such as described in U.S. Pat. No. 4,111,787, can be impregnated on the coal before liquefaction. Alternately, the catalysts can be blended with the recycled solvent. Instead of soluble catalysts, finely ground particulate catalysts (less than 200 mesh) can be used. The particulate iron catalyst is selected from the free metal, oxides, hydroxides, pyrite, carbonates, pyrrhotite, triolite, iron sulfides having a structure $Fe_{1-x}S$ where $0 \leqq x < 1$, inorganic salts of iron such as sulfate, thiosulfate, nitrate and chloride or organic salts such as acetate and oxalate. The Group VI or Group VIII non-ferrous catalyst, in particulate form, is selected from oxides, hydroxides, sulfides, sulfates, nitrates, halides, selenides, tellurides, phosphates, carbonates and organic acid salts.

The iron catalyst would preferably be used in a concentration of from 0.5 to 5 wt% based upon the feed coal. The non-ferrous catalyst would preferably be used in a concentration of from 0.005 to 0.05 wt% (50 to 500 ppm) metal based on feed coal. Optimally, the iron is added in an amount of approximately 1 wt% metal, while the Group VI or VIII catalyst is added in a concentration of 0.02 wt% metal based upon feed coal. The ratio of the iron catalyst to the nonferrous catalyst should be in the range of 97.5/2.5% to 99.5/0.5% based on metal.

The feed coal in its particulate form and impregnated with the desired co-catalyst combination is then slurried with a hydrogen donor solvent which comprises essentially a hydrocarbon solvent without any significant level of water therein. Alternately, the feed coal is slurried with the solvent containing the soluble or fine particulate catalyst. Although any hydrocarbon solvent which displays hydrogen donor and transfer capabilities and ability for rehydrogenation is useful in the present invention, specific solvents which can be used include tetralin or hydrogenated or unhydrogenated anthracene or creosote oils. Preferably, the hydrogen donor solvent comprises a fraction of the liquid fuel product of the coal liquefaction process. In this instance, the hydrogen donor solvent can be easily recycled for continuous use through the process with makeup solvent being provided from the liquid fuels being produced.

The process derived solvent has a boiling range of approximately 450°–1000° F. The solvent may contain an SRC recycle product fraction taken from the separated solids of the process. The product SRC fraction (heavy SRC, light SRC or full range SRC) may be present in the solvent in a range of 0 to 35%.

The slurry mix tank can be maintained at temperatures up to 450° F. by controlling the temperature of the recycle solvent and residual fraction SRC recycle. In the slurry mixtank, moisture entrained in the feed coal and impregnated coal may be removed, if desired, by maintaining the temperature in the mix tank at an elevated level, while allowing the moisture to escape as steam. The slurry is then pumped from the mix tank to the liquefaction reactor through a preheater.

The liquefaction process is conducted at a temperature in excess of 750° F. Preferably the reaction is conducted at a temperature in the range of 750° to 850° F. The reaction is additionally conducted under an elevated hydrogen pressure of from 500 to 5000 psia, preferably 1000 to 2000 psia. The rate of hydrogen flow in the reactor is 15,000 to 50,000 SCF/ton of coal, preferably 20,000 SCF/ton of coal.

The coal and recycle solvent undergo a number of chemical transformations in the liquefaction reactor, including, but not necessarily limited to: dissolution of coal in the liquid, hydrogen transfer from the recycled solvent to the coal, hydrogenation of recycle solvent, removal of heteroatoms (S, N, O) from the coal and recycle solvent and hydrocracking of heavy coal liquids. It is in this liquefaction reactor that the co-catalyst system performs the catalytic action upon the hydrocarbonaceous materials that results in increased oil products and increased total conversion of coal, while at the same time reducing the production of hydrocarbon gases.

After a reaction time of 10 to 120 minutes, preferably 40 minutes, the coal liquefaction product along with unreacted hydrogen, produced hydrocarbon and heteroatom gases, hydrogen donor solvent, ash and residual catalyst are removed for separation into the three major phases. The gases are separated from the liquid product containing process solvent, liquefied coal, unconverted coal, and ash in a gas-liquid separator. The product gas stream is further treated to recover hydrocarbon gases including $C_1$–$C_5$, acid gases such as $H_2S$, CO, and $NH_3$, and unreacted hydrogen. The unreacted hydrogen is recycled back to the liquefaction reactor. The liquid product stream is then either subjected to filtration or centrifugation to separate solid liquefaction residue containing ash and unconverted coal from the residue-free liquid stream. The liquid stream is then distilled to recover recycle solvent and product distillable oils. The non-distillable material is cooled to produce full-range solid solvent refined coal (SRC) containing low ash and sulfur. Alternatively, the liquid product stream from the gas-liquid separator is distilled first to recover recycle solvent and distillable oils from the non-distillable solid solvent refined coal and liquefaction residue (unconverted coal and ash). The non-distillable stream is then processed in a critical solvent deashing unit to produce three different product streams: a low ash and sulfur content heavy SRC (HSRC) which is rich in preasphaltenes, a low ash and sulfur content light SRC (LSRC) which is rich in asphaltenes, and a liquefaction residue containing unconverted coal and ash. The full range SRC, HSRC or LSRC can be recycled to the liquefaction reactor as a feed for further liquefacton treatment, and to further increase the production of distillable oils. The liquefaction residue, containing unconverted coal and ash, can be partially oxidized in a known manner with an oxygen-enriched gas stream in order to produce a hydrogen-rich gas for export or use as the feed hydrogen for the coal liquefaction reactor.

The distillable liquid fuel product is preferably fractionated in a distillation column to produce various grades of liquid fuels, as well as a solvent for recycle to the front end of the liquefaction process.

The catalyst system of the present invention has been found to produce unexpected increases in the quantity of liquid fuel produced from coal in relation to the other products of the coal liquefaction, but in increasing the liquid product recovery, the consumption of hydrogen is minimized, while the production of hydrocarbon gases is actually decreased. Furthermore, the overall coal conversion to recoverable products is unexpectedly increased with the co-catalyst system. The increase in coal conversion will result in decreased production of liquefaction residue and therefor reduce the load on filtration, centrifugation or critical solvent deashing units. The reduction in the load on the solid/liquid separation devices will also cause a reduction in operating expenses and will eventually improve the process economics. These unexpected results are shown in greater detail in the following examples.

EXAMPLE 1

This example illustrates the reaction of coal without additives. The feed slurry was comprised of Kentucky Elkhorn #2 coal having the composition shown in Table 1 and a process solvent having the elemental composition and boiling point distribution shown in Tables 2 and 3, respectively. A coal oil slurry (70 wt% solvent+30 wt% coal) was passed into a one-liter continuous stirred tank reactor at a total pressure of 2000 psig and a hydrogen flow rate of 20,000 SCF/T of coal. The reaction temperature was 825° F. and the nominal residence time was 35 minutes. The reaction product distribution obtained was as shown in Table 4. The conversion of coal was 85.3% and the oil yield was 12.2% based on moisture-ash-free (maf) coal. The sulfur content of the residual hydrocarbon fraction (SRC) was 0.61 percent and the hydrogen consumption was 0.64 wt% of maf coal.

TABLE 1

| Analysis of Elkhorn #2 Coal | Weight % |
|---|---|
| Proximate Analysis | |
| Moisture | 1.55 |
| Dry Ash | 6.29 |
| Ultimate Analysis | |
| C | 77.84 |
| H | 5.24 |
| O | 7.20 |
| N | 1.75 |
| S | 1.08 |
| Distribution of Sulfur | |
| Total Sulfur | 1.08 |
| Sulfate Sulfur | 0.04 |
| Pyritic Sulfur | 0.25 |
| Organic Sulfur | 0.79 |

TABLE 2

| Elemental Composition of Solvent | Weight % |
|---|---|
| Element | |
| Carbon | 89.7 |
| Hydrogen | 7.2 |
| Oxygen | 1.4 |
| Nitrogen | 1.1 |
| Sulfur | 0.6 |
| Number Average Molecular Weight | 208 |
| NMR Distribution of Hydrogen, % | |
| $^{H}$Aromatic | 44.4 |
| $^{H}$Benzylic | 28.0 |
| $^{H}$Other | 27.6 |

TABLE 3

| Simulated Distillation of Solvent | |
|---|---|
| Weight % Off | Temperature, °F. |
| I.B.P. | 519 |
| 5 | 548 |
| 10 | 569 |
| 20 | 590 |
| 30 | 607 |
| 40 | 627 |
| 50 | 648 |
| 60 | 673 |
| 70 | 699 |
| 80 | 732 |
| 90 | 788 |
| 95 | 835 |
| 98 | 878 |
| F.B.P. | 911 |

TABLE 4

| Conversion and Product Distribution of Kentucky Elkhorn #2 Coal | |
|---|---|
| Feed Composition | 70% Solvent + 30% Coal |
| Temp., °F. | 825 |
| Time, Min. | 35 |
| Pressure, psig | 2,000 |
| $H_2$ Flow Rate, SCF/T | 20,000 |
| Product Distribution, wt. % MAF Coal | |
| HC | 5.2 |
| CO, $CO_2$ | 0.7 |
| $H_2S$ | 0.3 |
| Oil | 12.2 |
| Asphaltene | 21.2 |
| Preasphaltene | 44.2 |
| SRC* | (65.4) |
| I.O.M. | 14.7 |
| Water | 1.5 |
| Conversion | 85.3 |
| Hydrogen Consumption, wt. % MAF Coal | 0.64 |
| SRC Sulfur, % | 0.61 |
| Total Recoverable product | 82.8 |
| Selectivity ($SE_1$) oils/hydrocarbon gas | 2.3 |
| Selectivity ($SE_2$) oils/hydrogen consumption | 19.1 |

*SRC = sum of the asphaltenes and preasphaltenes.

EXAMPLE 2

This example illustrates the catalytic activity of iron impregnated on coal. The coal sample described in Example 1 was impregnated with one weight percent iron as $FeSO_4$ obtained from Textile Chemical Company, Reading, Pa. The chemical analysis of iron sulfate is given in Table 5. The impregnated coal and solvent feed slurry was processed at the same reaction conditions described in Example 1. The product distribution obtained is shown in Table 6. Both conversion of coal and oil yield were higher with iron impregnated coal than shown in Example 1. Hydrogen consumption was significantly lower with iron impregnated coal than shown in Example 1. The total amount of recoverable product, selectivity ($SE_1$) and ($SE_2$) were also higher with iron impregnated coal than shown in Example 1. The X-ray diffraction analysis of residue from liquefaction reaction showed complete conversion of $FeSO_4$ to pyrrhotite.

EXAMPLE 2a

This example illustrates the catalytic activity of iron added as particulate pyrite in coal liquefaction. The coal and solvent feed slurry described in Example 1 was combined with finely ground pyrite (<325 U.S. mesh) at a concentration level of 10.0 weight percent of slurry (14.0 weight percent iron based on feed coal) with the solvent weight percent reduced. The slurry was processed at the same reaction conditions described in Example 1. The pyrite was obtained from the Robena Mine at Angelica, Pa., and is described in Table 7. The product distribution obtained is shown in Table 8. Conversion of coal and the amount of total recoverable product with 14.0% iron added as pyrite were considerably higher than Example 2. Oils production and hydrocarbon gas production were also higher that Example 2. The increase in coal conversion, total recoverable product, oils and hydrocarbon gas production were obtained at the expense of considerable increase in hydrogen consumption. The selectivities for oils over hydrocarbon gas production ($SE_1$) and for oils production over hydrogen consumption ($SE_2$) decreased dramatically with 14.0% Fe added as pyrite over iron impregnated coal (Example 2). Therefore, addition of higher concentrations of iron does increase oils and total recoverable product, but the increase is not selective, making it economically unattractive.

EXAMPLE 3

This example illustrates the catalytic activity of molybdenum impregnated on coal. The coal sample described in Example 1 was impregnated with 0.02 weight percent (200 ppm) molybdenum as ammonium molybdate obtained from Climax Molybdenum Company, Greenwich, Conn. The impregnated coal and solvent feed slurry was processed at the same reaction conditions described in Example 1. The product distribution obtained is shown in Table 6. Conversion of coal was nearly identical to that obtained with iron impregnated coal as shown in Example 2. Oil and hydrocarbon gas production with molybdenum impregnated coal was higher than shown in Example 1 and lower than shown in Example 2. SRC sulfur content was comparable to that shown in Example 2. Hydrogen consumption was considerably lower than shown in Example 1. The amount of recoverable product was higher than Examples 1 and 2. Selectivity ($SE_1$) was higher than Example 1, but was lower than Example 2. Similarly, selectivity ($SE_2$) was higher than Example 1, but was lower than Example 2.

EXAMPLE 3a

This example illustrates the catalytic activity of molybdenum added as particulate molybdenite (molybdenum disulfide) in a coal liquefaction. The coal and solvent feed slurry described in Example 1 was combined with finely ground molybdenite (<400 U.S. mesh) obtained from Climax Molybdenum Company, Greenwich, Conn., at a concentration level of 0.05 wt% molybdenum (500 ppm) as molybdenite based on coal. The slurry was processed at the same reaction conditions described in Example 1. The product distribution obtained is described in Table 9. Conversion of coal and the amount of total recoverable product with 0.05% molybdenum added as molybdenite were slightly higher than Example 3. Oils and hydrocarbon gas production were also higher than Example 3. The increase in coal conversion, total recoverable product, oils and hydrocarbon gas production were obtained at the expense of increased hydrogen consumption. The selectivity for oils over hydrocarbon gas production ($SE_1$) was unchanged compared to Example 3, but selectivity for oils production over hydrogen consumption ($SE_2$) decreased with 0.05% Mo compared to Example 3. Therefore, addition of a higher concentration of molybdenum does increase oils and total recoverable product, but the increase is not significant enough to justify the increased quantity of molybdenum. This is because molybdenum catalyst is expensive and increasing the concentration from 0.02 to 0.05% will more than double the catalyst cost without any significant gain.

EXAMPLE 3b

This example illustrates catalytic activity of molybdenum added as particulate molybdenum oxide in coal liquefaction. The coal and solvent feed slurry described in Example 1 was combined with finely ground molybdenum oxide (<300 U.S. mesh) obtained from Climax Molybdenum Company, Greenwich, Conn., at a concentration level of 2.0 wt% molybdenum (20,000 ppm) as molybdenum oxide based on coal. The slurry was processed at the same reaction conditions described in Example 1. The product distribution obtained is described in Table 9. Conversion of coal and the amount of total recoverable product with 2.0% molybdenum added as molybdenum oxide were considerably higher than Examples 3 and 3a. Oils and hydrocarbon gas production were higher than Example 3, but were comparable to Example 3a. The hydrogen consumption was higher than Examples 3 and 3a. The increased hydrogen consumption was not utilized for increasing oils and hydrocarbon gas production, but was consumed for hydrogenating the reaction products, which is not desirable. Selectivity for oils production over hydrocarbon gas production ($SE_1$) was comparable to Example 3, but selectivity for oils production over hydrogen consumption ($SE_2$) decreased considerably compared to Examples 3 and 3a due to higher hydrogen consumption. Therefore, addition of very high concentration of molybdenum is not desirable.

EXAMPLE 4

This example illustrates the unexpected results in the catalytic activity when both iron and molybdenum were impregnated on coal. The coal sample described in Example 1 was impregnated with both 1.0 wt. percent iron described in Example 2 and 0.02 wt. percent molybdenum described in Example 3. The impregnated coal and solvent feed slurry was once again processed at the same reaction conditions described in Example 1. The product distribution obtained is shown in Table 6. Both conversion of coal and oil yield were significantly higher with coal impregnated with iron and molybdenum than shown in Example 1, 2 and 3. The production of hydrocarbon gases was also lower than Examples 1, 2 and 3. Hydrogen consumption was higher than Examples 2 and 3. SRC sulfur content was slightly higher than Examples 1, 2 and 3. The amount of total recoverable product was considerably higher than Examples 2 and 3. Furthermore, the selectivity for oils production over hydrocarbon gas production ($SE_1$) was significantly higher than Examples 2 and 3. The increased selectivity dramatically shows the most efficient use of a combination of catalysts in coal liquefaction to increase oil production over hydrocarbon gas production. The selectivity for oils production over hydrogen consumption ($SE_2$) was comparable to Example 2, but was significantly higher than Example 3. This observation clearly indicates that the oils production was significantly increased, while either maintaining or increasing the efficient use of hydrogen.

TABLE 5

| Analysis of Iron Sulfate ($FeSO_4$) | Weight % |
|---|---|
| Ferrous Sulfate, $FeSO_4$ | 53.78 |
| Iron, $Fe_2O_3$ | 0.06 |
| Titanium, $TiO_2$ | 0.33 |
| Magnesium Sulfate, $MgSO_4$ | 1.80 |
| Copper, Cu | 0.0004 |
| Lead, Pb | 0.0005 |
| Water Insoluble Material | 8.28 |
| Water of Crystallization | 43.28 |

TABLE 6

| Conversion and Product Distribution of Kentucky Elkhorn #2 Coal | Example 2 | Example 3 | Example 4 |
|---|---|---|---|
| Catalyst, Wt. % Coal | 1.0% Iron | 0.02% Molybdenum | 1.0% Iron + 0.02% Molybdenum |
| Feed Composition | 70% Solvent + 30% Impregnated Coal | | |
| Temp., °F. | 825 | 825 | 825 |
| Time, Min. | 32.8 | 36.5 | 37.2 |
| Pressure, psig | 2,000 | 2,000 | 2,000 |
| $H_2$ Flow Rate, SCF/T | 18,900 | 23,700 | 23,400 |
| Product Distribution, Wt. % MAF Coal | | | |
| HC | 3.5 | 4.1 | 3.1 |
| CO, $CO_2$ | 0.6 | 0.7 | 0.7 |
| $H_2S$ | 0.2 | 0.6 | 0.6 |
| Oil | 25.0 | 21.7 | 36.3 |
| Asphaltene | 19.1 | 17.6 | 15.2 |
| Preasphaltene | 35.8 | 40.3 | 33.1 |
| SRC* | (54.9) | (57.9) | (48.3) |
| I.O.M. | 13.5 | 13.2 | 9.3 |
| Water | 2.3 | 1.8 | 1.7 |
| Conversion | 86.5 | 86.8 | 90.7 |
| Hydrogen Consumption, Wt. % MAF Coal | 0.40 | 0.40 | 0.59 |
| SRC Sulfur, % | 0.61 | 0.61 | 0.67 |
| Total Recoverable Product | 83.4 | 83.7 | 87.7 |
| Selectivity ($SE_1$) | 7.1 | 5.3 | 11.7 |
| Selectivity ($SE_2$) | 62.5 | 54.2 | 61.5 |

*SRC = asphaltenes and preasphaltenes

TABLE 7

| Analysis of Robena Pyrite | Weight % |
|---|---|
| C | 4.5 |
| H | 0.3 |
| N | 0.6 |
| S | 41.3 |
| O | 6.0 |
| Fe | 42.3 |
| Sulfur Distribution | |
| Pyrite | 40.4 |
| Sulfate | 0.7 |
| Organic | 0.6 |
| Other Impurities in ppm - Al, Si, Na, Mn, V, Ti, | |

TABLE 7-continued

| Analysis of Robena Pyrite | Weight % |
|---|---|
| Cr, Sr, Pb, Co, Mg, Mo, Cu and Ni | |

TABLE 8

| Conversion and Product Distribution of Kentucky Elkhorn #2 Coal | Example 2a |
|---|---|
| Catalyst | Pyrite |
| Concentration of Fe, Wt % Coal | 14.0 |
| Temp., °F. | 825 |
| Time, Min. | 39 |
| Pressure, psig | 2,000 |
| $H_2$ Flow Rate, SCF/T | 23,000 |
| Product Distribution, Wt % MAF Coal | |
| HC | 5.7 |
| CO, $CO_2$ | 0.9 |
| $H_2S$* | 0.0 |
| Oil | 28.2 |
| Asphaltene | 24.3 |
| Preasphaltene | 29.6 |
| SRC** | (53.9) |
| I.O.M. | 8.1 |
| Water | 3.2 |
| Conversion | 91.9 |
| Hydrogen Consumption, Wt % MAF Coal | 1.68 |
| SRC Sulfur, % | 0.60 |
| Total Recoverable Product | 87.8 |
| $SE_1$ | 4.9 |
| $SE_2$ | 16.8 |

*Does not include $H_2S$ generated in reduction of pyrite
**SRC = asphaltene and preasphaltene

TABLE 9

| Conversion and Product Distribution of Kentucky Elkhorn #2 Coal | Example 3a | Example 3b |
|---|---|---|
| Catalyst | Molybdenum Disulfide | Molybdenum Oxide |

TABLE 9-continued

| Conversion and Product Distribution of Kentucky Elkhorn #2 Coal | Example 3a | Example 3b |
|---|---|---|
| Concentration of Mo, Wt % of Coal | 0.05 | 2.0 |
| Temp., °F. | 825 | 825 |
| Time, Min. | 36.3 | 40.7 |
| Pressure, psig | 2,000 | 2,000 |
| $H_2$ Flow Rate, SCF/T | 23,200 | 25,600 |
| Product Distribution, Wt % MAF Coal | | |
| HC | 4.8 | 4.5 |
| CO, $CO_2$ | 0.6 | 0.7 |
| $H_2S$ | 0.4 | 0.4 |
| Oil | 25.2 | 25.2 |
| Asphaltene | 18.0 | 34.9 |
| Preasphaltene | 36.3 | 22.3 |
| SRC* | (54.3) | (57.2) |
| I.O.M. | 12.9 | 9.2 |
| Water | 1.8 | 2.8 |
| Conversion | 87.1 | 90.8 |
| Hydrogen Consumption, Wt % MAF Coal | 0.52 | 1.03 |
| SRC Sulfur, % | 0.55 | 0.60 |
| Total Recoverable Product | 84.3 | 86.9 |
| Selectivity ($SE_1$) | 5.3 | 5.6 |
| Selectivity ($SE_2$) | 48.5 | 24.5 |

*SRC = asphaltene and preasphaltene

As is shown in Examples 2, 3 and 4 and their respective products slates set forth in Table 6, the use of a co-catalyst combination of iron and molybdenum provides an unexpected increase in the desired liquid fuel product from the stated coal liquefaction process. In liquefying coal, the preferred product is a liquid fuel or distillable oil which has direct market value for the replacement of petroleum fuels and refinery feeds. The production of hydrocarbon gases constitutes an undesired by-product, which preferably is minimized to the greatest extent possible. This is because the hydrocarbon gases have a reduced market value in comparison to a liquid fuel product. In addition, the production of high quantities of hydrocarbon gases results in an unnecessary increase in the hydrogen consumption, making the coal liquefaction process economically unattractive. Inherently in all coal liquefaction processes, a certain level of undistillable product remains from the process in the form of solvent refined coal or SRC. SRC comprises predominantly asphaltenes and preasphaltenes. Although asphaltenes and preasphaltenes can be recycled or alternately, sold as a boiler fuel, it is preferred to reduce the preasphaltenes or benzene insoluble components of coal to asphaltenes which are the benzene soluble components of coal as this brings the SRC closer to the conversion of SRC to distillable oils or liquid fuel product. The preasphaltene deficient and asphaltene rich streams can be converted very easily to distillable oils in a downstream hydrocracker. In this respect, the overall conversion of the coal liquefaction process is important in order to demonstrate that not only liquid fuels are being produced but the preasphaltenes are being reduced to asphaltenes and of course asphaltenes are being converted to distillable oils. A preferred catalyst in a preferred process would be specific to such goals. Rather than generally increasing the conversion of coal to less complex hydrocarbons which would eventuate in increased hydrocarbon gas production as conversion is increased, the desired process and catalyst system would be specific to the production of distillable oils or liquid fuel product by the reduction of increased amounts of the preasphaltene and asphaltene components of coal without the production of large quantities of economically undesirable hydrocarbon gases. Any such increased gas production requires an undesirable increase in hydrogen consumption. This is an expensive input to a coal liquefaction process.

Yet another desirable attribute of a coal liquefaction process is the optimization of the yield of recoverable products. An increase in the yield of recoverable products increases the total revenue of the process for a given coal through-put, and therefore it improves the economics of the coal liquefaction. Another attribute of a coal liquefaction process should be the minimization of the amount of unconverted coal (increase overall conversion). Unconverted coal is normally separated out from the liquefied coal in a solid-liquid separation step and disposed of as liquefaction residue along with coal ash. Alternatively, it can be partially oxidized to form the hydrogen required for the process. As the coal conversion increases, the amount of unconverted coal and, thereby, the total amount of solid liquefaction residue decreases. This decrease in the total amount of liquefaction residue reduces the load on solid-liquid separation devices and, thereby, improves their performance and decreases their operating cost. This also makes the overall process more economical.

The present co-catalyst combination system achieves all of these goals while producing an unexpected level of liquid fuels for a given coal feed. As shown in Table 6 for Example 4 wherein the co-catalyst combination comprised iron sulfate and ammonium molybdate, overall conversion of coal rose from the individually catalyzed runs of Example 2 and Example 3 by 4.2%, a significant rise in overall conversion. Despite the rise in overall conversion, the production of hydrocarbon gases actually decreased for the preferred catalyst system of Example 4. This is a completely unexpected result and is contrary to the general trend, wherein as conversion goes up the gas make necessarily also goes up. The results of Example 4 show an unexpected specificity for liquid production over mere reduction in molecular size of all hydrocarbons present in the coal liquefaction reactor.

The most dramatic result of the co-catalyst combination of Example 4 is the production of 36.3% oils based upon feed material. This significant result constitutes an 11.3% greater quantity of oil for a catalyzed coal liquefaction process then the individually catalyzed runs of Examples 2 and 3. Such an absolute increase in the production of oil constitutes a 45% increase over the production level of the iron catalyzed liquifaction process of Example 2 wherein the oil make was 25% based upon feed coal.

Although the production of a liquid fuel product is the most important aspect of the present invention, it is also significant to note the reduction in the asphaltene and preasphaltene level of the co-liquefaction product of the present invention as exemplified in Example 4 when compared with the individually catalyzed runs of Example 2 and Example 3. Asphaltenes were shown to be reduced by 2.4%, while preasphaltenes were reduced by 2.7%. The reduction in preasphaltenes and asphaltenes is important in that the increased oil make is possible because of the specificity of the catalyzed reaction of the present invention for the conversion of these high molecular weight materials to oils, whereas the oil is not being further hydrocracked to hydrocarbon gases. This specificity for the avoidance of the production of hydrocarbon gases while producing unexpectedly high levels of the desired liquid fuel product constitutes the significant result of the present invention.

The biggest operating cost in any coal liquefaction process is the cost of process hydrogen. Hydrogen consumption mainly determines the economic attractiveness of a coal liquefaction process. Therefore, a coal liquefaction process improvement should increase the oil production while minimizing any increase in the hydrogen requirements (selectivity $SE_2$). Since any hydrocarbon gas production is achieved at the expense of additional hydrogen requirements above that necessary for oil production, any process improvement should also increase the selectivity ($SE_1$) of oil production over hydrocarbon gas production. The present invention as exemplified in Example 4 achieves dramatic increases in both of these process parameters, selectivity $SE_1$ and $SE_2$. Table 10 discloses a comparison of the present invention as exemplified in Example 4 and the various individually catalyzed examples (Ex. 2 and 3) and the uncatalyzed example (Ex. 1). All data is given as the percent increase. $SE_1$ is the selectivity for oils in relation to hydrocarbon gas produced per unit of coal processed. An increase in this value reduces undesired gas product, but also has an effect on increasing oil make and reducing or minimizing hydrogen requirements. In converting coal to distillable oils, it is undesirable to produce hydrocarbon gas because it is produced by the further breakdown of oil, thus depleting the desired product after the product has been produced from the coal. $SE_2$ is the selectivity for oil in relation to hydrogen consumed per unit of coal processed. Although it is related to the selectivity $SE_1$ for hydrocarbons, it is also affected by the process characteristics such as catalyst and solvent attributes. Because of the expense of hydrogen, a desirable coal liquefaction process should minimize hydrogen use for a given production of oil from coal.

TABLE 10

Comparison of Results of Initial Runs

| | Ex. 1 | Ex. 2 | Ex. 3 | Ex. 4 |
|---|---|---|---|---|
| Catalyst: | No catalyst | Iron | Mo | Fe/Mo |
| Increase in oil prod. % | — | 104.9 | 77.9 | 197.5 |
| Increase in coal conv. % | — | 1.4 | 1.8 | 6.3 |
| Increase in total recoverable product % | — | 0.7 | 1.1 | 5.9 |
| Increase in $SE_1$ % | — | 208.7 | 130.4 | 408.7 |
| Increase in $SE_2$ % | — | 227.2 | 183.8 | 222.0 |

Although the present invention has been demonstrated with a specific catalyst combination, it is apparent that obvious changes in the catalyst components and the process steps can be contemplated by one skilled in the art and these variations are deemed to be within the scope of the present invention, which scope should be ascertained from the claims which follow.

What is claimed:

1. A process for the liquefaction of coal in an essentially hydrocarbon hydrogen donor solvent at a temperature above 750° F. using a feed comprising: coal, solvent and a freshly added unsupported co-catalyst combination of iron and a Group VI or VIII non-ferrous metal or compounds of the catalyst.

2. The process of claim 1 wherein the liquefaction is conducted at a pressure in the range of 500 to 5000 psia.

3. The process of claim 2 wherein the pressure is maintained with hydrogen gas.

4. The process of claim 3 wherein the solvent is recycled.

5. The process of claim 1 wherein the Group VI or VIII catalyst is selected from the group comprising molybdenum, tungsten, cobalt or nickel or their compounds.

6. The process of claim 1 wherein the co-catalyst combination is iron and molybdenum or their compounds.

7. The process of claim 1 wherein the co-catalyst combination is iron sulfate and ammonium molybdate.

8. The process of claim 1 wherein the iron catalyst is present in a predominance by weight percent over the Group VI or VIII nonferrous catalyst.

9. The process of claim 1 wherein the catalyst combination is impregnated on the coal prior to the liquefaction reaction.

10. The process of claim 1 wherein the catalyst combination is present in a concentration of at least 0.5–5 wt% of iron based on the coal and 0.005–0.05 wt% of the Group VI or VIII metal catalyst based on coal.

11. The process of claim 1 wherein the co-catalyst combination comprises 1 wt% iron as iron sulfate and 0.02 wt% molybdenum as ammonium molybdate based on feed coal.

12. The process of claim 1 wherein the co-catalyst is used in a ratio of iron to Group VI or VIII nonferrous in the range of 97.5% iron/2.5% nonferrous to 99.5% iron/0.5% nonferrous, based on metal.

13. A process for the liquefaction of coal in an essentially hydrocarbon hydrogen donor solvent at a temperature above 750° F., at pressure in the range of 500 to 5000 psia and in the presence of a hydrogen gas atmosphere using a feed comprising: coal, solvent and a freshly added unsupported co-catalyst combination of 0.5–5 wt% iron and 0.005–0.05 wt% molybdenum metal or compounds of the catalyst based on coal.

* * * * *